US011848166B2

(12) United States Patent
Porcella et al.

(10) Patent No.: US 11,848,166 B2
(45) **Date of Patent: *Dec. 19, 2023**

(54) KEYBOARD WITH ADJUSTABLE FEEDBACK

(71) Applicant: Apple Inc., Cupertino, CA (US)

(72) Inventors: John A Porcella, Campbell, CA (US); Daniel A. Greenberg, Santa Clara, CA (US); Thomas R. Matzinger, Los Osos, CA (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/445,056

(22) Filed: Aug. 13, 2021

(65) Prior Publication Data

US 2021/0375564 A1 Dec. 2, 2021

Related U.S. Application Data

(63) Continuation of application No. 16/446,239, filed on Jun. 19, 2019, now Pat. No. 11,094,483.
(Continued)

(51) Int. Cl.
*H01H 13/85* (2006.01)

(52) U.S. Cl.
CPC ..... *H01H 13/85* (2013.01); *H01H 2215/03* (2013.01); *H01H 2231/002* (2013.01)

(58) Field of Classification Search
None
See application file for complete search history.

(56) References Cited

U.S. PATENT DOCUMENTS 5,434,566 A * 7/1995 Iwasa ..... H01H 13/84 400/481
6,218,966 B1 * 4/2001 Goodwin ..... G06F 3/0202 341/20

(Continued)

FOREIGN PATENT DOCUMENTS

CN 108400980 A * 8/2018 ..... G06F 21/316
WO WO-2005098737 A2 * 10/2005 ..... G01D 21/00

OTHER PUBLICATIONS

Savioz, et al., "Toward multi-finger haptic devices: a computer keyboard with adjustable force feedback", Electrical Machines and Systems (ICEMS), 2011 International Conference—Beijing, Aug. 20-23, 2011, pp. 1-6.

*Primary Examiner* — Curtis A Kuntz
*Assistant Examiner* — Jerold B Murphy
(74) *Attorney, Agent, or Firm* — DORSEY & WHITNEY LLP

(57) ABSTRACT

Keyboards, input devices, and related systems include key mechanisms with keycaps and actuators that provide adjustable feedback in response to user input. The actuators are controllable to provide variable tactile force or audible feedback that is dependent upon the user input. Encoders are able to transduce a location or relative position of a keycap as it is being pressed over time, and a signal is provided to actuators to cause them to provide feedback corresponding to the position of the keycap as it moves. The feedback can change the feel or sound of the keycap based on the keycap positions, time of operation, velocity, user identity, and other factors. Thus, the feel or sound of a keyboard or related input device can be adjusted electronically for efficient testing and increased user customization and feedback modes.

20 Claims, 11 Drawing Sheets

Related U.S. Application Data

(60) Provisional application No. 62/821,867, filed on Mar. 21, 2019.

(56) References Cited

U.S. PATENT DOCUMENTS

| | | | | |
|---|---|---|---|---|
| 8,619,035 | B2 * | 12/2013 | Ciesla | G06F 3/016 340/407.2 |
| 9,501,149 | B2 * | 11/2016 | Birnbaum | G06F 3/016 |
| 11,094,483 | B2 * | 8/2021 | Poncella | H01H 13/85 |
| 2012/0032886 | A1 * | 2/2012 | Ciesla | G06F 3/016 345/168 |
| 2014/0034471 | A1 | 2/2014 | Krumpelman et al. | |
| 2015/0293592 | A1 | 10/2015 | Cheong et al. | |
| 2016/0005557 | A1 * | 1/2016 | Mizutani | H01H 13/702 200/5 A |
| 2018/0219552 | A1 * | 8/2018 | Casparian | H01F 7/204 |
| 2019/0025925 | A1 | 1/2019 | Zellers et al. | |
| 2019/0073457 | A1 * | 3/2019 | Jiang | H04L 63/00 |

* cited by examiner

KEYBOARD WITH ADJUSTABLE FEEDBACK

CROSS-REFERENCE TO RELATED APPLICATION(S)

This is a continuation of U.S. patent application Ser. No. 16/446,239, filed Jun. 19, 2019, and entitled "KEYBOARD WITH ADJUSTABLE FEEDBACK," which claims priority to U.S. Provisional Patent Application No. 62/821,867, filed Mar. 21, 2019, and entitled "KEYBOARD WITH ADJUSTABLE FEEDBACK," the entire disclosures of which are hereby incorporated by reference.

FIELD

The described embodiments relate generally to devices and methods for controlling feedback provided by key mechanisms of a keyboard or by a similar input device. More particularly, the present embodiments relate to a keyboard system with adjustable and variable feedback.

BACKGROUND

Keyboards and other computer interface devices are an essential part of an overall user experience provided while operating electronic devices such as desktop computers, notebook/laptop computers, tablet computers, and smartphones. Buttons and key mechanisms provide tactile, visual, and audible feedback that is often a point of scrutiny by users when they evaluate the comfort and quality of the device. Accordingly, device makers carefully design and control this feedback in order to meet and exceed customer expectations.

For devices such as keyboards that have interrelated mechanical and electrical parts, testing and prototyping can be excessively expensive and slow. In order to experiment with new technologies or new force feedback profiles for key switches, entire prototype keyboards need to be built and delivered. The feel and sound of the interaction of these parts can be unpredictable and can therefore require iterative design techniques with round after round of new prototypes being ordered, constructed, tested, evaluated, and revised. Within the fast-paced world of computing device development, these iterative processes can be overly limiting and inefficient.

Additionally, although device makers make efforts to make products that are comfortable and effective for a wide range of different types of end users, most keyboards and interface devices are substantially static in their feel and sound once they are in end use. End-users and third party sellers are mostly unable to customize and control those factors. What seems like comfortable and satisfying feedback to one user can be deemed completely inadequate (e.g., overly noisy, stiff or mushy) in feel to another. Consumers would rather not have to compromise on their keyboard in a device that otherwise meets their needs. Accordingly, there is a persistent need for various improvements to the implementation of keyboards and related input devices for electronic devices.

SUMMARY

Aspects of the present disclosure relate to a keyboard. The keyboard can comprise a support surface and a set of key mechanisms positioned above the support surface. Each key mechanism can include a keycap to receive an input force applied by a user input, an encoder to transduce a position of the keycap and to output an electronic signal corresponding to the position of the keycap, and an actuator to apply an output force to the keycap, with the output force being dependent upon the electronic signal from the encoder.

In some embodiments, the keyboard can further comprise a controller receiving the electronic signal from the encoder and being in electronic communication with the actuator, wherein the controller is configured to control the output force based on a function of the position of the keycap relative to the support surface. The function can be modified by a user in various ways. For instance, the function can comprise a first configuration corresponding to a first velocity of the keycap relative to the support surface and a second configuration corresponding to a second velocity of the keycap relative to the support surface, with the first configuration being different from the second configuration.

In some embodiments, the actuator can comprise a piezoelectric portion or can comprise a magnetic body to apply a magnetic force to the keycap based on a function of the position of the keycap. The actuator can in some cases comprise a damping component configured to apply a damping force to the keycap in response to a rate of displacement of the keycap.

Another aspect of the disclosure relates to a computer interface system. The system can comprise a processor, a keyboard in electronic communication with the processor, and a memory device in electronic communication with the processor. The keyboard can include an actuator and a keycap linked to the actuator. The memory device can store instructions, wherein, upon receipt of the instructions from the memory device, the processor can be configured to provide a first signal to the actuator, with the first signal causing the actuator to apply a first feedback force to the keycap, receive a user input, and provide a second signal to the actuator in response to receiving the user input, with the second signal causing the actuator to apply a second feedback force to the keycap, and with the second feedback force being different from the first feedback force.

The system can further comprise a position sensor, wherein the user input is a displacement of the keycap sensed by the position sensor. The user input can be received via an electronic user interface element. The keyboard can generate a first sound when the actuator applies the first feedback force, and the keyboard can generates a second sound when the actuator applies the second feedback force, with the first sound being different from the second sound. The first feedback force can limit displacement of the keycap past a first displacement value, and the second feedback force can limit displacement of the keycap past a second displacement value, the first displacement value being different from the second displacement value. The user input can be a force applied to the keycap, wherein the second feedback force comprises a higher resistance to movement of the keycap than the first feedback force.

The processor can also be further configured to detect a first user identity before providing the first signal to the actuator, wherein the first feedback force corresponds to the first user identity, and detect a second user identity by receiving the user input. The second user identity can be different from the first user identity, wherein the second feedback force can correspond to the second user identity. The first feedback force can be different from the second feedback force due to having at least one of a different click ratio, a different tactile peak force magnitude, a different tactile peak force displacement, a different bottom-out force, a different bottom-out displacement, a different tactile bottom force magnitude, a different tactile bottom force displacement, a different stiffness at full travel, a different pre-load weight, a different drop stroke length, or a different key profile hysteresis. The user input can comprise a keycap velocity indicator, and the second feedback force can be greater than the first feedback force when the keycap velocity indicator exceeds a threshold velocity value.

Yet another aspect of the disclosure relates to a computer interface system comprising a processor, a keyboard in electronic communication with the processor, and a memory device in electronic communication with the processor. The keyboard can include a first key mechanism comprising a first keycap and a first actuator and a second key mechanism comprising a second keycap and a second actuator. The memory device can be in electronic communication with the processor, and the memory device can store instructions. Upon receipt of the instructions from the memory device, the processor can be configured to detect a signal from the first key mechanism, determine a user objective from the signal, and adjust respective first and second feedback forces applied by the first and second actuators to the first and second key mechanisms based on the user objective.

In some embodiments, determining the user objective comprises determining an anticipated input, wherein at least one of the first and second feedback forces are adjusted to guide a user to the anticipated input. The first and second feedback forces can comprise different force values. Determining the user objective can comprise detecting an unintentional user input, wherein at least one of the first and second feedback forces can be adjusted to reduce repetition of the unintentional user input.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
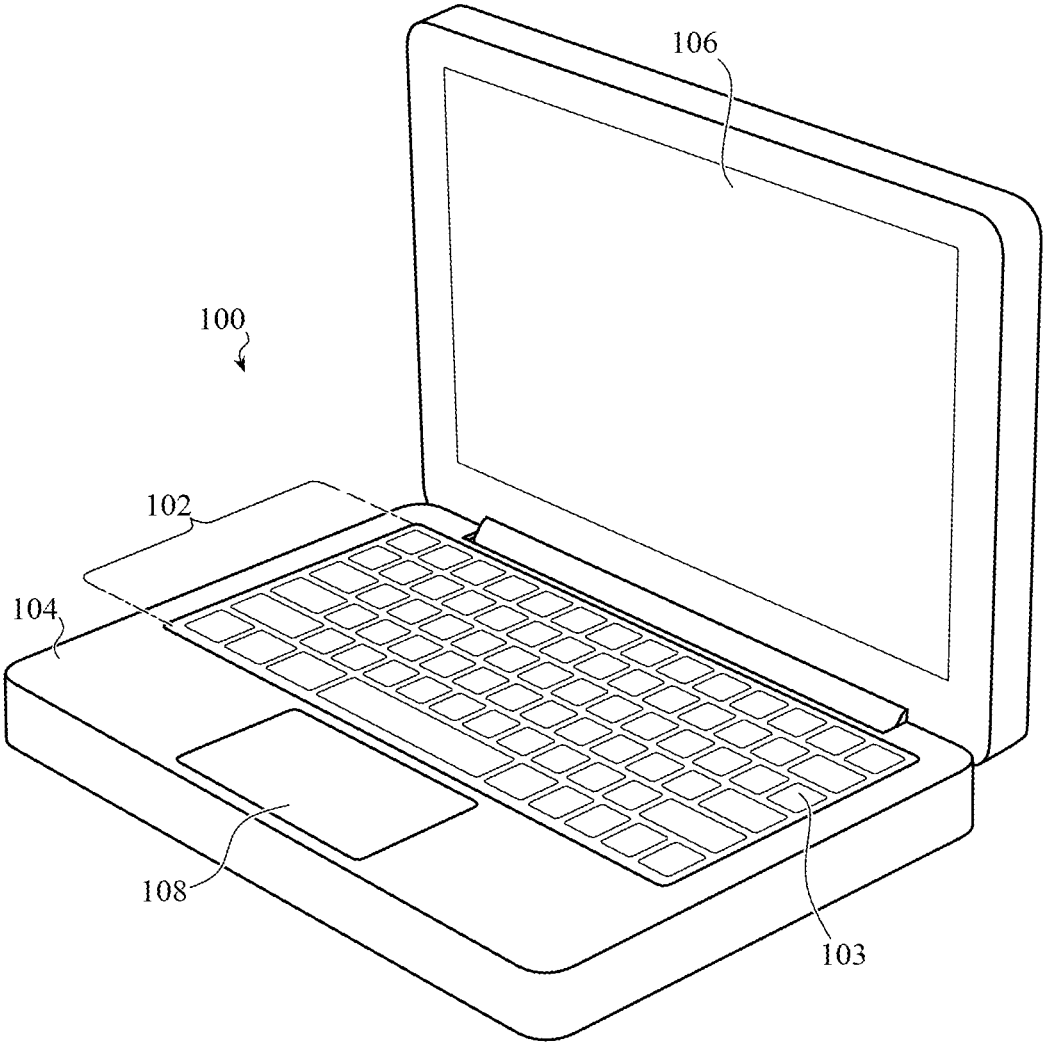
FIG. 1 shows an isometric view of an electronic device of the present disclosure.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

One aspect of the present disclosure relates to a keyboard (or another input device) having key mechanisms with adjustable and customizable feedback. The keyboard can be used, for example, as an input device in an electronic device, as a testing apparatus, or as a device for rapidly prototyping and replicating feedback of various key mechanisms. The feedback can include many factors, such as, for example, feel, tactility, smoothness, roughness, sound (e.g., pitch, volume, or tone), travel distance, perceived travel distance, and other similar characteristics. The key mechanisms in the keyboard can each comprise a keycap or other input-receiving structure (e.g., a flexible membrane/"rubber key", button, knob, switch, etc.), an encoder or other position or movement transducer, and an actuator or resistance control device. Other transducers for detecting user input can include force transducers (e.g., a load cell), user position transducers (e.g., rangefinding sensors configured to determine the position of the keycap, a user instrument, or the user's finger or hand), and noise and vibration transducers (e.g., to detect user activity external to the key mechanisms). With a user position transducer, the system can detect finger distance from a keycap, finger approach velocity, and other user characteristics before the user has touched a keycap or other input surface.

The position of the keycap can be measured or detected by the encoder, and a signal can be provided to the actuator to provide feedback to the keycap that corresponds to the position, velocity, jerk, and/or acceleration of the keycap. Accordingly, when a user presses the keycap, force feedback provided to resist the movement of the keycap can be controlled based on an electronic signal from an encoder, i.e., based on the position or movement of the keycap relative to a reference point. In some embodiments, the force feedback can be controlled to follow a force-displacement function, and that function can be adjusted or changed according to user input (e.g., changes to user-provided settings) or based on other sensed factors (e.g., the velocity of the keycap movement).

Relative to conventional prototyping methods, the actuators of the keyboard can change their feedback output relatively quickly and easily due to the feedback being electronically controlled rather than being solely based on the physical properties of a particular prototype model. As a result, a keyboard having these key mechanisms can have user-customizable key feel, sound, and other feedback characteristics. For example, a user can adjust the same keyboard to have a heavier feel on one day and to have a lighter key feel on another day. The customizability of the keyboard can enable users to inexpensively test many different types of feedback in a short period of time, thus allowing them to rapidly find preferred feedback settings for various times, tasks, programs, users, or other use cases or conditions. In some cases, individual keys on a keyboard can have individualized custom feedback (i.e., different from other keys in the same keyboard).

The keyboard feedback settings can be adjustable using an electronic user interface such as a visual user interface provided on a display. The user interface can display feedback settings for various keys in a keyboard, force-displacement curves and diagrams for different key mechanisms, speed-based feedback settings, feedback schedules, other customization parameters, and an interface to change the parameters for one or more keys.

In some embodiments, the actuators can comprise motors, electroactive polymers, and magnets to provide feedback forces. Actuators can also include dampers (or can simulate dampers) to provide speed-related feedback forces. The actuators can comprise or work alongside biasing members such as springs to provide at least a portion of the feedback forces (e.g., a pre-load force) or can work with support surfaces to provide keycap support and limits to keycap movement.

Another aspect of the disclosure relates to detecting and responding to user input detected by the encoders of the keyboard. User identities can be determined while a user types on a keyboard based on the force applied to the keys, the speed of the typing, whether the keys are pressed all the way down to a bottom-out condition, whether user-identifying mistakes are made while typing, and other factors. These factors can be analyzed in order to determine the identity of a user via their typing characteristics, and the user's identity can then be used to control or change computer functions or to change the nature of the feedback provided by the keyboard.

Yet another aspect of the disclosure relates to adjusting feedback forces or adjusting keycap positioning in a reactive or predictive manner. The system can detect a signal from a key mechanism and then determine a user objective from the signal. For example, the system can determine that a certain word or phrase is being typed, that the user is using a particular application (e.g., playing a particular game using the keyboard), that the user is likely to make a typing mistake while a word is being produced, or another deduced or predicted activity. The system can then adjust the feedback forces applied by different actuators to different keycaps of the keyboard so as to minimize input mistakes or to guide the user to perform expected functions or objectives more conveniently. For instance, if a user is detected as playing a game that heavily uses the W, A, S, and D keys, those keys can be adjusted to have a lighter weight relative to neighboring keys so that the neighboring keys are less likely to be inadvertently triggered. If a user is typing a long word, the keyboard can react by reducing the feedback weight of the keys for the letters at the end of the word or by causing a retraction of the keycaps of letters that are not at the end of the word in order to guide the user to the expected letters needed to finish the word.

These and other embodiments are discussed below with reference to the figures. However, those skilled in the art will readily appreciate that the detailed description given herein with respect to these figures is for explanatory purposes only and should not be construed as limiting.

FIG. 1 depicts an electronic device 100 including a keyboard 102. The keyboard 102 includes keys or key assemblies with keycaps (e.g., keycap 103) or button caps that move when depressed by a user. The electronic device 100 can include one or more devices or mechanisms that allow adjustability of the feedback provided by the keyboard 102, such as encoder and actuator elements within a housing 104 of the electronic device 100.

Figure 17:
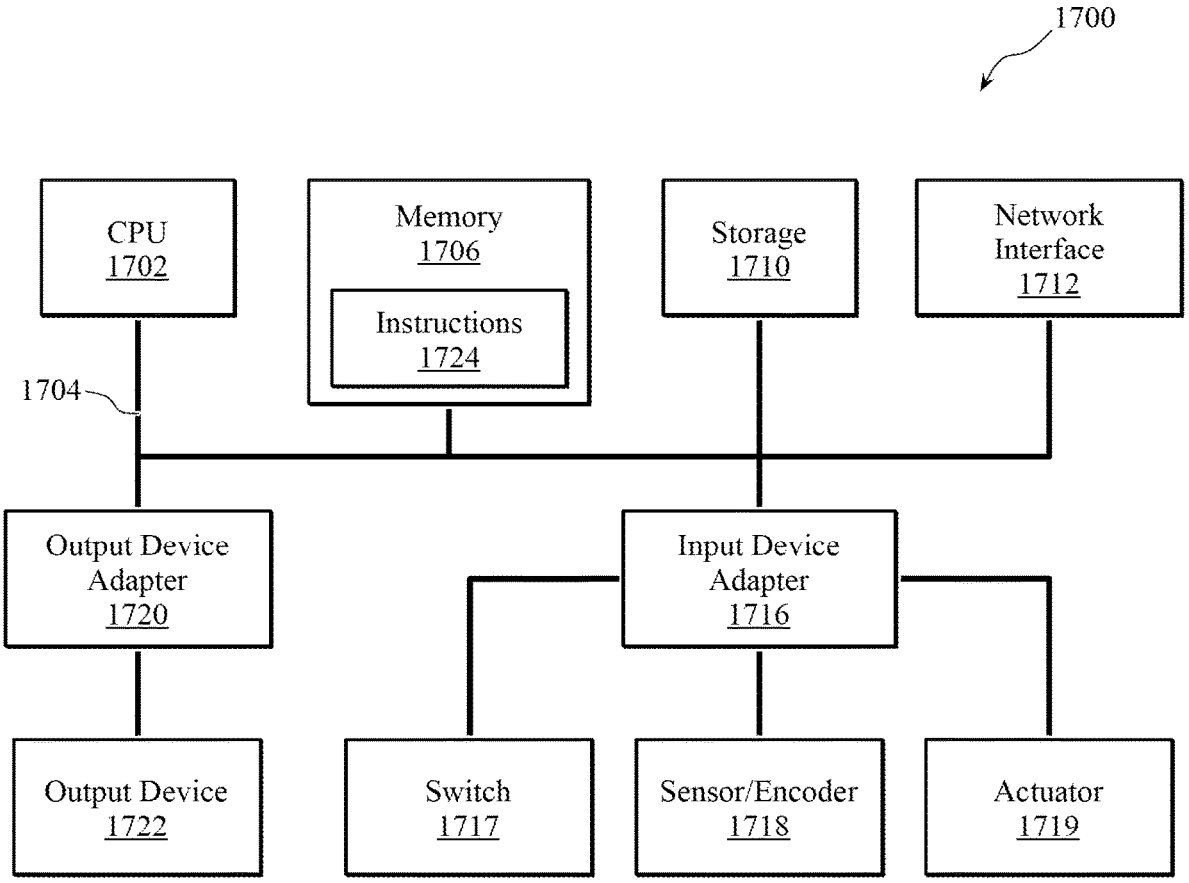
FIG. 17 is a schematic diagram of electronic components for embodiments of the present disclosure.

The electronic device 100 can also include a display screen 106, a track pad 108 or other pointing device, and internal electronic components used in a notebook/laptop computer (e.g., a processor, electronic memory device, electronic data storage device, and other computer components; see FIG. 17). The display screen 106 can be positioned on a portion of the housing 104 configured to extend upright relative to the keyboard 102. The track pad 108 can be positioned on the housing 104 adjacent to the keyboard 102 on a side of the keyboard 102 opposite the display screen 106. Upper and lower portions of the housing 104 can be joined by a hinge located between the display 106 and the keyboard 102.

Although the electronic device 100 of FIG. 1 is a notebook/laptop computer, it will be readily apparent that features and aspects of the present disclosure that are described in connection with the notebook computer can be applied in various other devices. These other devices can include, but are not limited to, personal computers (including, for example, computer "towers," "all-in-one" computers, computer workstations, and related devices) and related accessories, speakers, tablet computers, graphics tablets and graphical input pens/styluses, watches, headsets, other wearable devices, and related accessories, vehicles and related accessories, network equipment, servers, screens, displays, and monitors, photography and videography equipment and related accessories, printers, scanners, media player devices and related accessories, remotes, headphones, earphones, device chargers, computer mice, trackballs, and touchpads, point-of-sale equipment, cases, mounts, and stands for electronic devices, controllers for games, remote control (RC) vehicles/drones, augmented reality (AR) devices, virtual reality (VR) devices, home automation equipment, and any other electronic device that uses, sends, or receives human input. Thus, the present disclosure provides illustrative and non-limiting examples of the kinds of devices that can implement and apply aspects of the present disclosure.

Figure 2:
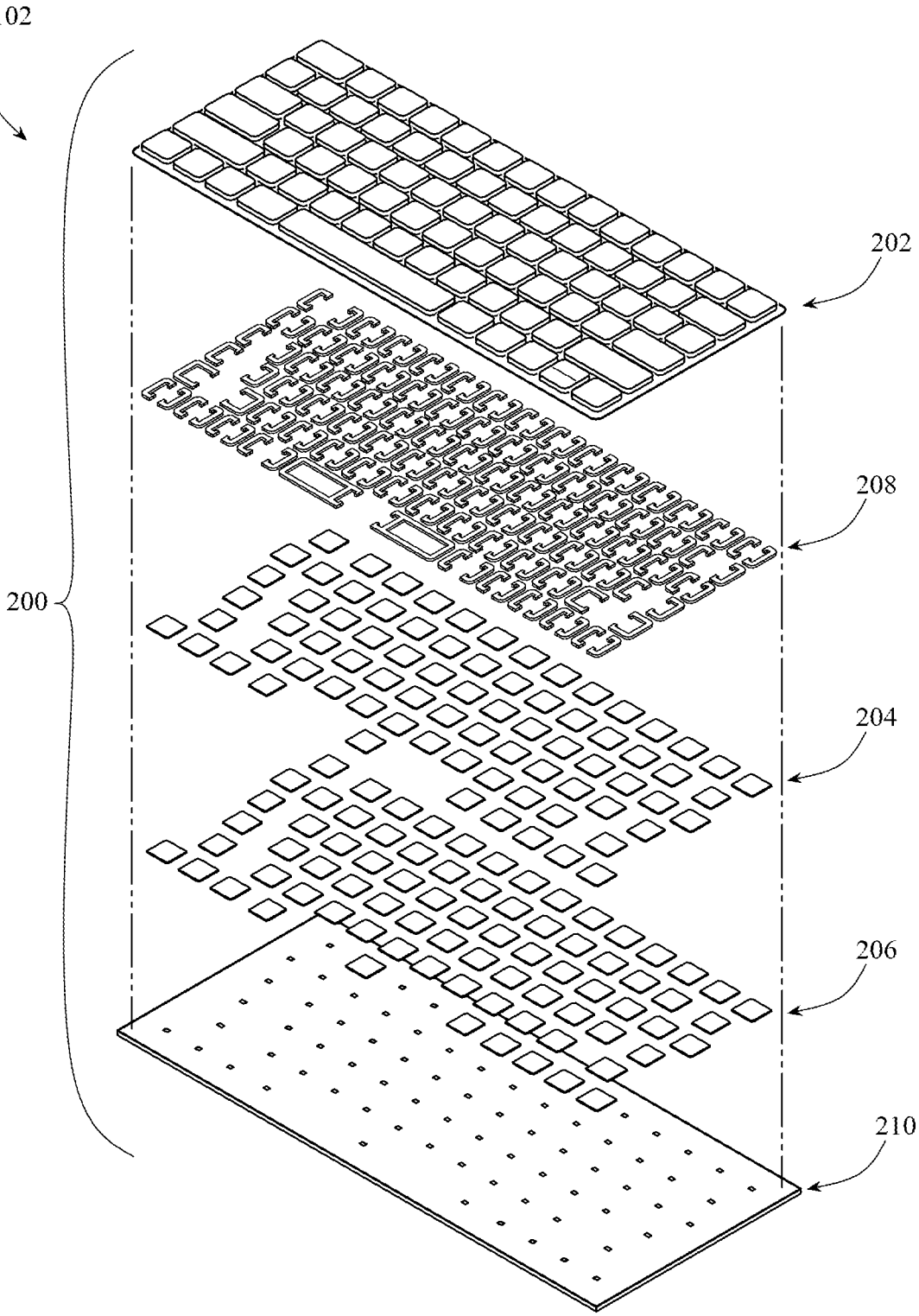
FIG. 2 shows an exploded view of a keyboard of the present disclosure.

The keyboard 102 can include a set of assembled components that correspond to each key. FIG. 2 shows an exploded isometric view of an example embodiment of the keyboard 102 having key mechanisms with layered elements. The assembly of these components can be referred to as a "stack-up" due to their substantially layered or stacked configuration. The keyboard 102 can comprise key mechanisms 200 including a set of keycaps 202, a set of encoders 204, a set of actuators 206, a set of stabilizers 208, and a support surface or substrate 210. In some embodiments, the key mechanisms 200 can also comprise biasing structures (e.g., springs, elastic domes, and related devices) between the keycaps 202 and the substrate 210, as discussed in greater detail in connection with FIGS. 3-7. It will be apparent to persons having skill in the art that although the present disclosure focuses on keyboard-related applications of the principles described herein, these principles such as using encoders and actuators to measure and provide input feedback can be applied to buttons, knobs, switches, sliders, hinges, trackpads, and other interactive interface devices.

The keycaps 202 can comprise a set of rigid bodies configured to be contacted by a user instrument such as a hand (e.g., finger or palm) or stylus. The user can contact a top or other outer surface of the keycaps 202 to provide an input force to the keycap and thereby cause movement of the keycap or cause the input force to be sensed by sensors (e.g., the encoders 204) in the keyboard 102. The keycaps 202 can comprise rigid materials such as metal, plastics, ceramics, glass, and related materials with high stiffness while having thin dimensions for their thicknesses. The keycaps 202 can be arranged in a keyboard layout such as, for example, an ANSI layout, an ISO layout, Colemak, Dvorak, numpad/tenkey layout, AZERTY layout, a custom layout, or a related layout for data input. The keycaps 202 can also comprise glyphs, symbols, and legends to indicate a function or purpose of the key mechanism it covers. Keycaps 202 can have various length or width dimensions to accommodate different functions or typing habits.

The stabilizers 208 can comprise supports for the keycaps 202 relative to the substrate 210. The support provided can allow a keycap to move vertically while its top surface remains substantially perpendicular to the direction of motion (i.e., it is substantially parallel to the substrate 210 or parallel to a horizontal direction) even if an off-center vertical force is applied to the top surface of the keycap. Accordingly, the stabilizers 208 can help keep the key mechanism aligned while the keycap is moving and thereby limit rotational movement of the keycap relative to the substrate 210. In some embodiments, the stabilizers 208 can comprise mechanical support mechanisms such as a butterfly mechanism, a scissor mechanism, linked vertical sliders, a synchronized-folding mechanical linkage, or a similar device. Key tilt (i.e., rotation about a horizontal axis through the keycap) can be considered part of the key feedback and can also be controlled via actuators to allow (via manual or automatic control) variable amounts of key tilt for at least one of the keys based on user preferences, system-detected user intent or objective, or other similar information described herein.

The encoders 204 and actuators 206 are shown diagrammatically in FIG. 2. Accordingly, under each keycap 202, the respective encoders 204 and actuators 206 can be positioned in a layered configuration (with either of the encoder 204 or actuator 206 on top of the other) or in a side-by-side configuration. See FIGS. 4-8. The encoders 204 and actuators 206 can be electrically connected to the substrate 210 and can thereby be in electrical communication with a controller (e.g., a controller built into the keyboard 102 or a controller/processor of the electronic device 100). See FIG. 17. The controller can then provide a signal to the actuators 206 to control the output forces applied by the actuators 206 to the keycaps 202. Alternatively, individual encoders 204 can be electrically connected to respective actuators 206, wherein electronic output signals of the encoders 204 are provided to the actuators 206 to control forces applied by the actuators 206 to the keycaps 202. The force applied to the keycaps 202 can be controlled based on the displacement of the keycaps 202 relative to a support surface (e.g., substrate 210), base, housing, or other relatively stationary point in the keyboard 102 due to output from the actuators 206.

Figure 3:
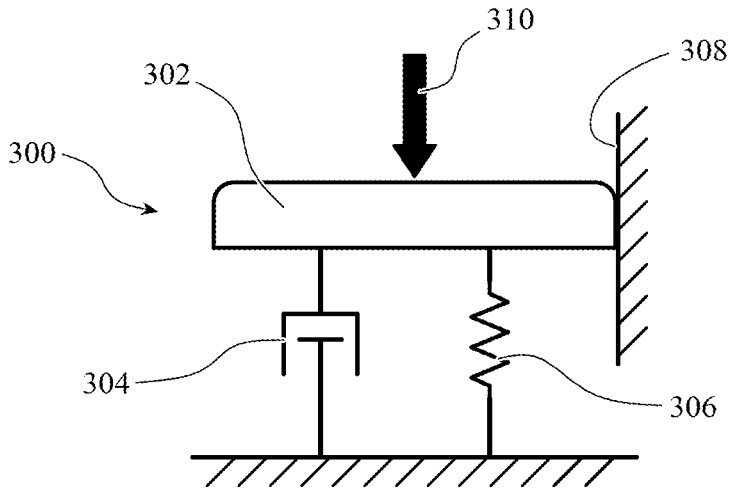
FIG. 3 shows a schematic illustration of a key model of the present disclosure.

The encoders 204 and actuators 206 can be configured to simulate various different types of feedback force properties provided to a keycap. For example, a schematic model 300 of a keycap 302 is shown in FIG. 3, wherein a keycap 302 is shown connected to a damper 304 and a biasing member 306 and is shown abutting an adjacent surface 308. When the keycap 302 is pressed in the keyboard 102, feedback or resistance applied by an actuator 206 can be controlled to simulate feedback that would be provided by these elements 304, 306, and 308. For example, actuators 206 and any other force-applying elements of the keyboard 102 (e.g., springs or elastic domes under the keycaps or friction between the keycaps and adjacent contacting surfaces) can provide a feedback force to the keycaps 202 that follows a predetermined force-displacement function that is based on biasing force provided by a biasing member 306, friction forces provided by an abutting surface 308, and damping forces provided by a damper 304.

In other words, when an input force 310 is applied to the keycap 302, as illustrated in FIG. 3, the actuator and other keycap-force-applying elements can provide feedback simulating feedback that would be provided by a damper 304, biasing member 306, contact between the keycap 302 and an abutting surface 308, frictional forces and inertial or other forces resulting from the mass and size of the keycap 302. In some embodiments, the user or device maker can model a key feel based on these elements 304, 306, 308, etc. and then design a force-displacement function that the keycap will follow when it is pressed by an input force 310, as described in greater detail elsewhere herein. Accordingly, the actuators disclosed herein can comprise components configured to simulate the operation of a damper (e.g., 304) and other components connected to a keycap (e.g., 302). The actuators can comprise damping components (e.g., servos, motors, and related devices having damping characteristics) that apply damping forces to the keycaps. This can be beneficial to a designer because they can provide their own preferred parameters for key feel and easily test and adjust those parameters rather than having to experiment with a variety of different prototypes and materials in order to figure out a preferred key feel. Actuator output can be tuned based on position, velocity, jerk, acceleration, user identity, user preferences, user intent or objective indicators, environmental characteristics, other similar factors, and combinations thereof.

Figure 4:
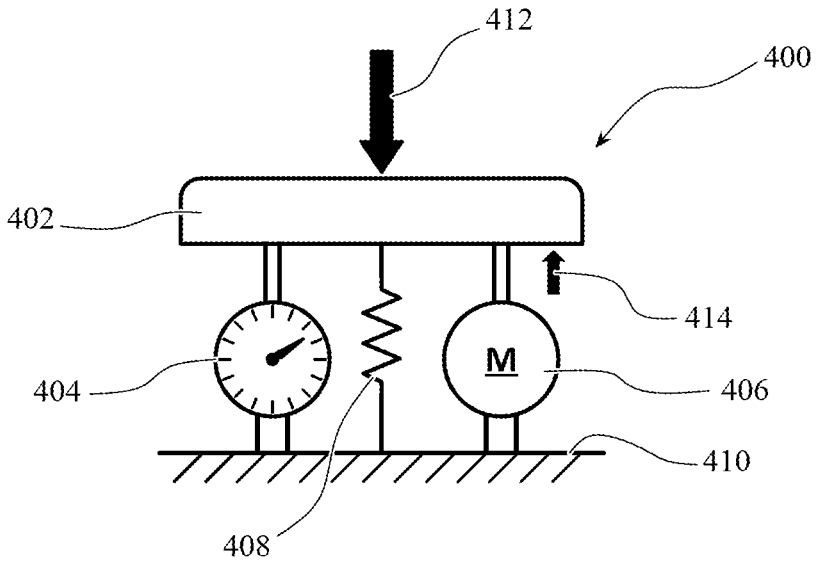
FIG. 4 shows a schematic illustration of a key mechanism of the present disclosure.

FIG. 4 shows another diagrammatic illustration showing a system 400 for providing feedback to a keycap 402. The keycap 402 can be one of the keycaps 202 of the keyboard 102. The body of the keycap 402 can be linked to an encoder 404, a motor 406, and a biasing member 408. In this case, the encoder 404 can include a linear encoder positioned between the keycap 402 and a support surface 410. The encoder 404 can be configured to transduce a position of the keycap 402 relative to the support surface 410 and can thereby output an electrical signal corresponding to an absolute position (or relative distance of movement) of the keycap 402 in response to application of an input force 412. The encoder 404 can be one of the encoders 204, and the motor 406 can be one of the actuators 206 in a side-by-side configuration.

The motor 406 is a type of actuator configured to cause a physical movement, to resist physical movement or to otherwise apply a force to the keycap 402 in response to an input electrical signal. The optional biasing member 408 can be a spring, elastic compressible dome, or other device used to apply a force in conjunction with the motor 406. Inclusion of the biasing member 408 can smooth out forces applied by the motor 406 to the keycap 402 and can reduce an output force requirement of the motor 406. For example, a biasing member 408 can provide a baseline amount of feedback to the keycap 402 that is supplemented or reduced by operation of the motor 406.

The electrical signal of the encoder 404 can be provided to the motor 406 (either directly, through a circuit, via a controller, or by similar processes), and the motor 406 can respond by applying a variable amount of force to the keycap 402 that counteracts the application of the input force 412, as represented by the output force 414. The output force 414 can be referred to as a feedback force, a resistance force, or a tactile force. The output force 414 can be dependent upon the displacement or position of the keycap 402 relative to the support surface 410. For example, the output force 414 can be greater at a small displacement of the keycap 402 relative to the output force applied at a greater displacement of the keycap 402. In some embodiments, the output force 414 can be applied wherein it increases over a first portion of the displacement of the keycap 402 and decreases over a second portion of the displacement of the keycap 402, as described in greater detail in connection with FIG. 9.

Figure 5:
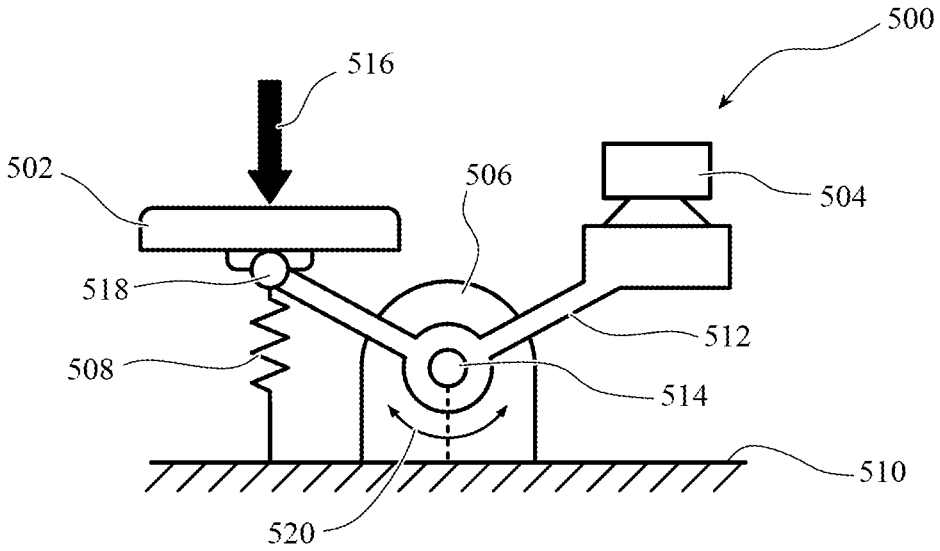
FIG. 5 shows a schematic illustration of a key mechanism of the present disclosure.

FIG. 5 schematically illustrates an alternative configuration wherein a system 500 comprises a keycap 502, an encoder 504, a rotary actuator 506, a biasing member 508, and a support surface 510. In this embodiment, the keycap 502 is linked to the encoder 504 and rotary actuator 506 via a rotatable linkage 512 having a pivot point 514 attached to a rotatable point of the rotary actuator 506. When an input force 516 is applied to the keycap 502, the linkage 512 can pivot about the pivot point 514 and at a connection point 518. Over small angular distances, the movement of the keycap 502 can be considered to be substantially linear in a vertical direction (i.e., along the direction of application of force 516). For example, the keycap 502 can vertically move less than one millimeter as the linkage 512 rotates.

The encoder 504 can be configured to transduce the displacement or movement of the keycap 502 and produce an electrical signal, as explained in connection with encoder 404. Thus, the encoder 504 can comprise a linear encoder such as a laser rangefinder or a caliper. The rotary actuator 506 (which can be a motor) can receive a signal to provide a feedback moment 520 to the linkage 512 that resists the movement of the keycap 502 in conjunction with a force applied by the optional biasing member 508 in a manner similar to the feedback forces described above. In some embodiments, the connection point 518 does not permit pivoting of the keycap 502 relative to the linkage 512. Accordingly, the system 500 can employ a sensor (e.g., encoder 504) and actuator (e.g., rotary actuator 506) that operate based on angular movement of a linkage 512 or keycap 502 rather than linear movement.

Figure 6:
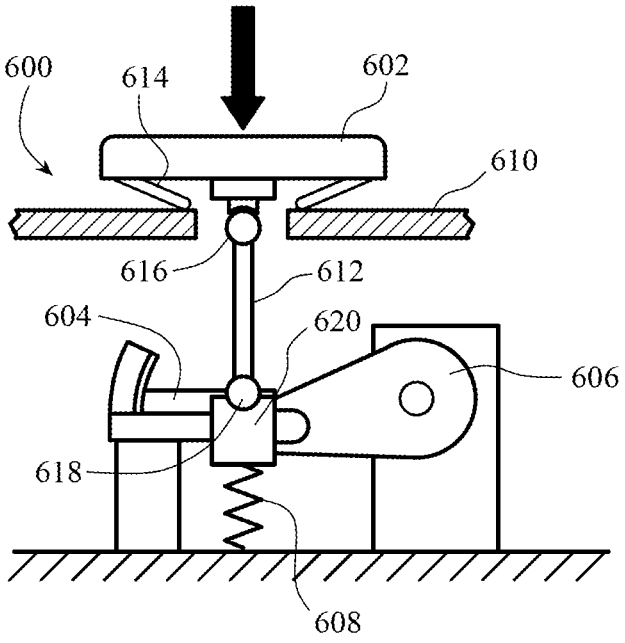
FIG. 6 shows a schematic illustration of a key mechanism of the present disclosure.

FIG. 6 illustrates another embodiment of a system 600 for a computer or electronic device interface having a keycap 602 connected to an encoder 604, actuator 606, and biasing member 608 via a linkage 612. The keycap 602 can be positioned on an external side of a housing 610 or other support body for a stabilizer 614. The linkage 612 can comprise smooth ball-to-plane or ball-to-socket pivot joints 616, 618 that help transfer linear vertical movement of the keycap 602 to an actuator arm 620 positioned on an internal side of the housing 610. The pivot joints 616, 618 can comprise magnetic elements to keep them assembled as the linkage 612 moves. The linkage 612 and joints 616, 618 can be referred to as a magnetically coupled linkage which provides angular degrees of freedom without backlash in the direction that primary forces are transmitted by the keycap, encoder, and actuator.

In this system 600, the encoder 604 can comprise a rotary encoder having a component configured to rotate in response to translation of the actuator arm 620 (via movement of the keycap 602 and linkage 612). The actuator 606 can provide a feedback force to the keycap 602 via the actuator arm 620 and linkage 612. The stabilizer 614 can help limit rotation of the keycap 602, particularly when a force is applied to the keycap 602 that is not centered above the linkage 612. The biasing member 608 can be an adjustable pre-load spring configured to provide a variable amount of pre-load force to the key mechanism. The keycap 602 can be one of many keycaps arranged in a keyboard configuration and layout so that many keys can be simultaneously tested with different or variable feedback characteristics.

The system 600 can be used in embodiments where miniaturization of the feedback system is not required, such as in keyboard test or modelling equipment. The housing 610 can therefore be a housing to a large computer or feedback prototyping machine that is larger than a notebook computer or similar relatively thin and light device. In some embodiments, the system 600 can be designed to fit within a portable device. In some embodiments, a single key, button, knob, hinge, or other similar device can be designed and tested using the apparatus shown in FIG. 6. For example, the system 600 can be used to design and test input devices for consumer electronics, computers, automotive applications, aircraft, spacecraft, robot controls (e.g., surgical robots), and any other applications where variable and multimodal switch feedback can be advantageous.

Figure 7:
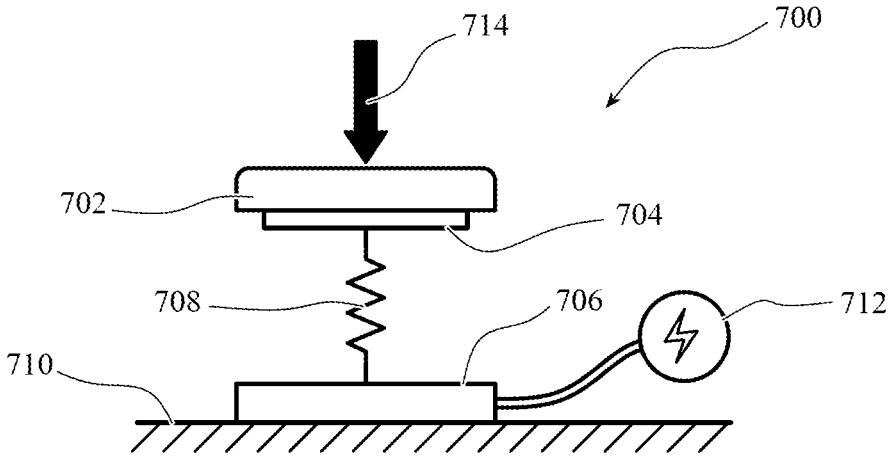
FIG. 7 shows a schematic illustration of a key mechanism of the present disclosure.

FIG. 7 schematically shows another embodiment of a system 700 for providing input feedback. The system 700 can include a keycap 702 having a first plate 704. The keycap 702 or first plate 704 is attached to a support surface 710 or second plate 706 using a stabilizer (not shown) or a biasing member 708. In some embodiments, the keycap 702 and first plate 704 are integrally combined as a single part.

The second plate 706 can comprise an adjustable magnet (e.g., an electromagnet) configured to apply a repelling force, an attracting force or both (e.g., sequentially applied), to the first plate 704 or the keycap 702. For example, a power source 712 can energize the second plate 706 with various degrees of power in order to control the strength of a magnetic force applied to the keycap 702 and first plate 704. In some embodiments, the controlled attraction or repulsion of the first and second plates 704, 706 can be the actuator configured to provide a variable feedback force to the keycap 702. When an input force 714 is applied to the keycap 702, the second plate 706 can produce a magnetic force that provides resistance to movement of the keycap 702. In some embodiments, the first plate 704 can comprise an adjustable magnet instead of, or in addition to, the second plate 706.

In some configurations, the plates 704, 706 can be part of a capacitive system, wherein the system can transduce the position of the keycap 702 relative to the support surface 710 based on measuring a capacitance or voltage difference between the plates 704, 706. Thus, the plates 704, 706 can be used as an encoder to provide a signal indicating a position or movement of the keycap 702. When an input force 714 is applied to the keycap 702, the displacement of the keycap 702 can be transduced by measuring a capacitance or change in capacitance between the plates 704, 706.

Figure 8:
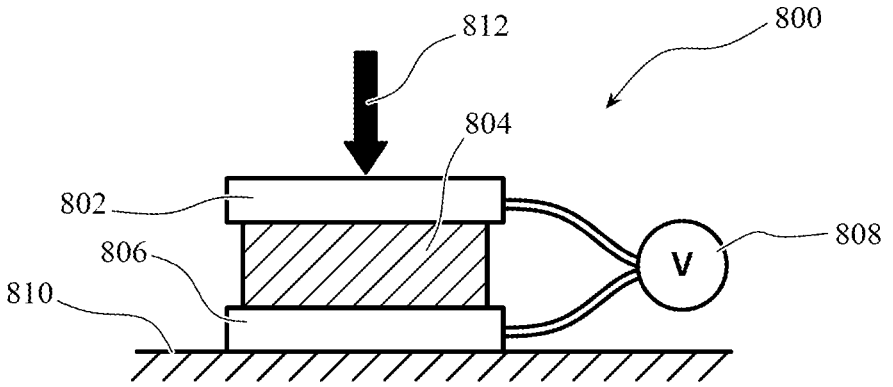
FIG. 8 shows a schematic illustration of a key mechanism of the present disclosure.

FIG. 8 schematically shows another embodiment of a system 800 for providing input feedback. The system 800 can include an upper plate 802 (which can comprise or can be connected to a keycap) attached via a spacer member 804 to a lower plate 806. The spacer member 804 can comprise a piezoelectric material such as, for example, an electroactive polymer (EAP) or similar material configured to change its physical dimensions in response to excitation by an electrical signal. The spacer member 804 can be compressible upon application of a force 812 to the upper plate 802. A voltage differential can be applied to the upper plate 802 and lower plate 806 (or directly to the spacer member 804) to change the dimensions of the spacer member 804 as a force 812 is applied to the upper plate 802. The voltage differential can be provided by a voltage source 808. The shape and stiffness of the spacer member 804 can provide a feedback force that counters the force 812 applied to the upper plate 802 and follows a predetermined force-displacement function.

Additionally, the spacer member 804 can react to an input force 812 by outputting an electrical signal corresponding to the distance between the upper plate 802 and the lower plate 806. Accordingly, the spacer member 804 can act as an encoder to transduce a force, movement, or position of the upper plate 802 relative to a base surface 810.

The feedback provided by the actuators of the systems described in connection with FIGS. 2-8 can be controlled in a variety of different ways and can be controlled to provide various different types of feedback. In some embodiments, the feedback comprises force feedback (i.e., haptic feedback or tactile feedback), wherein the magnitude of a feedback force applied to resist a user's input force is controlled based on the magnitude of the input force, based on the measured displacement of a key structure while the keycap is being pressed (which can be directly measured or can be derived from velocity or acceleration measurements over time), based on a velocity of the keycap (which can be directly measured or can be derived from displacement or acceleration measurements over time), or based on an acceleration of a keycap (which can be directly measured or can be derived from displacement or velocity measurements over time). In some embodiments, the feedback comprises audible feedback, wherein the feedback provided by the actuator causes the key mechanism or the actuator to make a variable sound in response to different settings. Controlling the actuator can enable the user or device maker to identify and implement a feel and sound for a keyboard or other input device that can be adjusted to desired alternative parameters quickly, inexpensively, easily, and without having to exchange the structural elements of the device.

Figure 9:
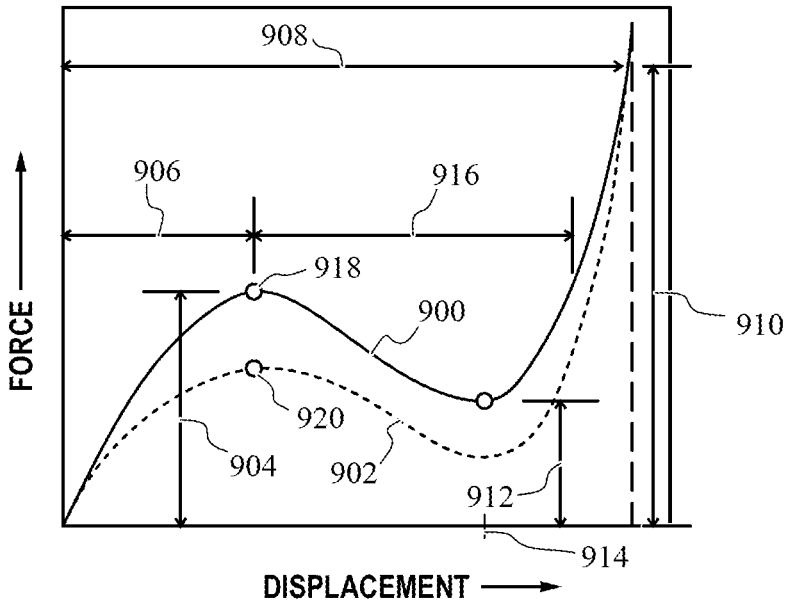
FIG. 9 illustrates force-displacement functions in accordance with the present disclosure.

In embodiments where a feedback force is controlled, various types of feedback can be adjusted using the systems described herein. FIG. 9 shows a force-displacement diagram that illustrates a force feedback function having various adjustable elements. Damping, biasing force resistance, friction resistance, inertia, and other characteristics of a system can be controlled to provide feedback following the functions shown in FIG. 9. The diagram illustrates a downstroke force-displacement curve 900 and an upstroke force-displacement curve 902. The downstroke curve 900 has a different profile than the upstroke curve 902, so there is a higher-magnitude feedback force applied to while the displacement of the keycap is increasing (i.e., being depressed relative to a neutral starting point) relative to while the displacement of the keycap is decreasing (i.e., returning to its starting point). Accordingly, actuators can be configured to provide different feedback to a keycap depending on the direction of its travel (e.g., upward movement versus downward movement).

Actuators of the present disclosure can be controlled to provide variable force feedback function characteristics. For example, a force-displacement function can have adjustable parameters or characteristics such as a tactile peak force magnitude 904, a tactile peak force displacement 906 (i.e., a displacement at a local maximum on the curve), an overall travel/bottom-out displacement 908, an overall travel/bottom-out force 910, a tactile bottom force magnitude 912 and displacement 914, a stiffness at full travel (i.e., a slope of the curve near the bottom-out displacement 908), a pre-load weight (which generally defines the average magnitude of the curve), a click ratio (i.e., a ratio of the tactile peak force magnitude 904 to the tactile bottom force magnitude 912), a drop stroke length 916 (i.e., a displacement distance that is the difference between the tactile peak force displacement 906 and a displacement equal to the tactile peak force magnitude 904 near the bottom-out displacement 908), and a key profile hysteresis amount (i.e., an overall area between the downstroke curve 900 and the upstroke curve 902, which area is representative of an energy difference between the downstroke and upstroke curves). The output force can be based on a function of the position of the keycap relative to a support surface.

Each of these metrics can be customized and controlled by actuators, wherein the output of the encoder corresponding to various displacement values can cause the actuators to provide the force magnitude values shown by the curves 900, 902. Accordingly, the feedback provided by the actuators can comprise force curves that limit displacement of a keycap past a first displacement value (i.e., to a first maximum bottom-out displacement) or curves that limit displacement of a keycap past a second, different displacement value (i.e., to a second maximum bottom-out displacement).

As used herein, a "tactile peak portion" of a force-displacement curve is a peak or local maximum resistance portion located at a displacement less than the bottom-out displacement 908 in an overall upstroke or downstroke curve. A processor can be configured to direct feedback output via actuators wherein the feedback comprises a tactile peak portion, as indicated by the local maxima 918, 920 shown in FIG. 9 which occur at approximately the tactile peak force displacement 906, which is less than the bottom-out displacement 908. Tactile peak portions are also illustrated in curves 1004, 1100, 1200, and 1202.

Figure 10:
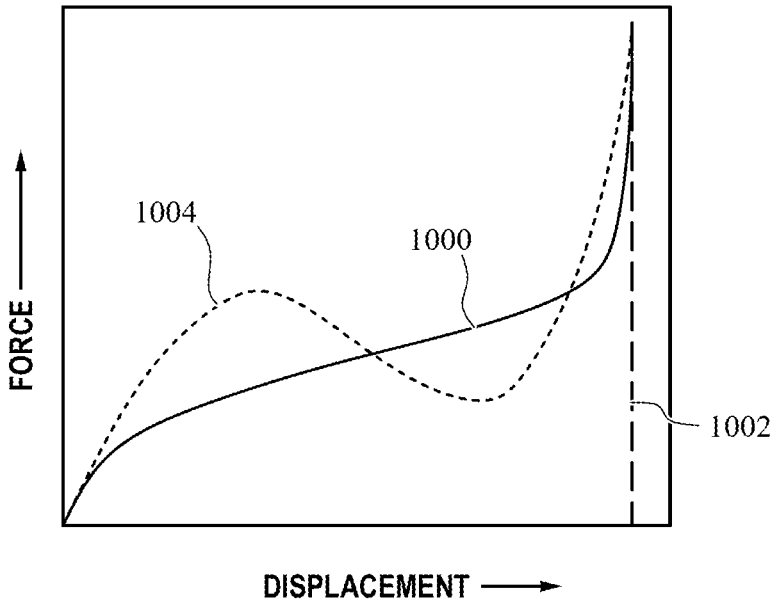
FIG. 10 illustrates force-displacement functions in accordance with the present disclosure.

In some embodiments, the type of tactility of the curves 900, 902 can be adjusted. For instance, FIG. 9 shows curves 900, 902 with a tactile peak portion between zero displacement and the bottom-out displacement 908. In FIG. 10, a more linear type of feedback is shown, wherein the downstroke force-displacement curve 1000 lacks any bump or tactile peak portion. It is noted that the downstroke force-displacement curve 1000 is not a linear curve per se. Rather, the curve includes a large portion (e.g., more than a majority of the curve along the displacement axis) that exhibits substantially linear behavior, representing substantial linear feedback through that displacement range. Thus, adjustment of the above-indicated adjustable parameters or characteristics can comprise reducing or eliminating a tactile peak along the displacement of the key mechanism. For example, the actuator output set to curve 900 can be adjusted and controlled to effectively provide a tactile peak force magnitude 904 that is less than the tactile bottom force magnitude 912 in the manner shown in curve 1000. The downstroke curve 1000 also has a higher stiffness at full travel as compared to curve 900, as indicated by the steeper slope near bottom-out displacement 1002. In some embodiments, the upstroke and downstroke curves of the system can differ in type, wherein a more linear downstroke curve (e.g., 1000) can be followed by a tactile upstroke curve (e.g., 1004), or vice versa.

Figure 11:
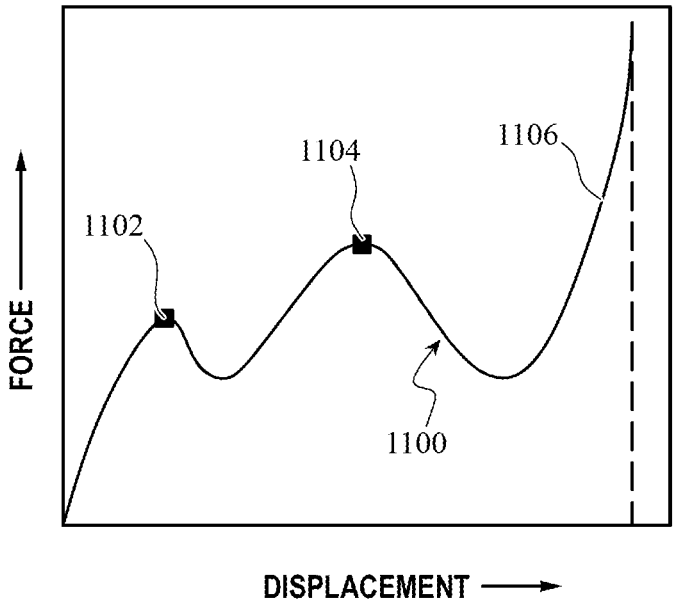
FIG. 11 illustrates a force-displacement function in accordance with the present disclosure.

FIG. 11 shows another embodiment wherein a downstroke curve 1100 comprises multiple tactile peak force portions, as shown by first and second local maxima 1102, 1104. In some embodiments, the force-displacement functions followed by the actuators can be adjusted between states in which there is no tactile peak force portions (as indicated in curve 1000), one tactile peak force portion (as indicated in curve 900, 902, or 1004), and two or more tactile peak force portions (as suggested in FIG. 11).

While these different functions have been shown in downstroke curves (e.g., curves 900, 1000, and 1106) in FIGS.

9-11, the upstroke curves can be similarly adjusted or characterized to have different numbers of tactile peak force portions. In this manner, the key mechanisms can be controlled to have a smoother or rougher tactile resistance and feedback depending on the user's preferences or other design considerations. A linear feedback curve is generally smoother to the touch, and a curve with more tactile peak portions or a jagged shape is generally perceived as being rougher or bumpier to the touch. Some users prefer a smoother feel and others prefer the feedback "click" of pressing through a bump or otherwise overcoming some resistance while the key moves.

In some embodiments, the force-displacement functions output by the actuators can be controlled based at least partially on the speed of the movement of the keycap or the amount of force applied to the keycap. Thus, the feedback of a key press can be automatically changed for faster or heavier typing. In other words, the user's action of applying a force to the keycap can be the only required user input to cause a change in the output of the actuators rather than being required to change settings by providing user input in some other way (e.g., through a graphical user interface or by adjusting a feedback-generating mechanism separate from the key mechanisms).

Figure 12:
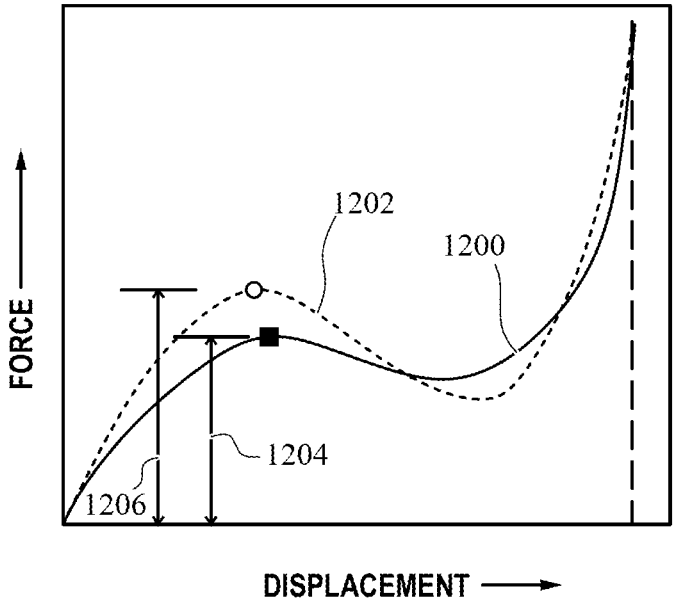
FIG. 12 illustrates force-displacement functions in accordance with the present disclosure.

As shown in FIG. 12, a force-displacement function can follow a first curve 1200 when a key moves at a first speed (e.g., relatively slowly) or when a key is pressed with a first magnitude of force (e.g., relatively lightly). The function can follow a second curve 1202 in response to a second key velocity or a second magnitude of applied force. Output of the encoders described herein can be used to determine key movement velocity or acceleration. In some configurations, additional velocity or force sensors can be implemented to determine key speed or forces applied to a keycap. Force measurements can be transduced using force sensors, strain gauges, and similar devices. Velocity indicators can include signals from an encoder, velocimeter, or accelerometer sensor measuring changes in position/displacement of keycaps over time, keycap velocity, or changes in acceleration of keycaps over time.

These signals can measure a threshold velocity value above which the actuator output changes from a function following the first curve 1200 (i.e., having a generally lower force feedback magnitude) to the second curve 1202 (i.e., having a generally higher force feedback magnitude) or vice versa. In other cases, the actuator output curves are configured to continuously vary based on the keycap speed or other input characteristics. For example, incremental changes in velocity can result in incremental changes to the actuator output between curves 1200 and 1202.

The first curve 1200 can have a lower first tactile peak force magnitude 1204 as compared to the second tactile peak force magnitude 1206 of the second curve 1202. This configuration can be beneficial to improve the feel of a tactile bump while typing at higher speeds or when higher forces are applied. A higher tactile peak force magnitude (e.g., 1206) can be felt more easily at higher speeds or under higher applied forces as compared to a lower tactile peak force magnitude (e.g., 1204). Other characteristics of the curves 1200, 1202 can be adjusted based on key movement speed or input forces applied, including any and all of the other curve characteristics described above, including, but not limited to, the number of tactile peak portions of the curves.

Figure 13:
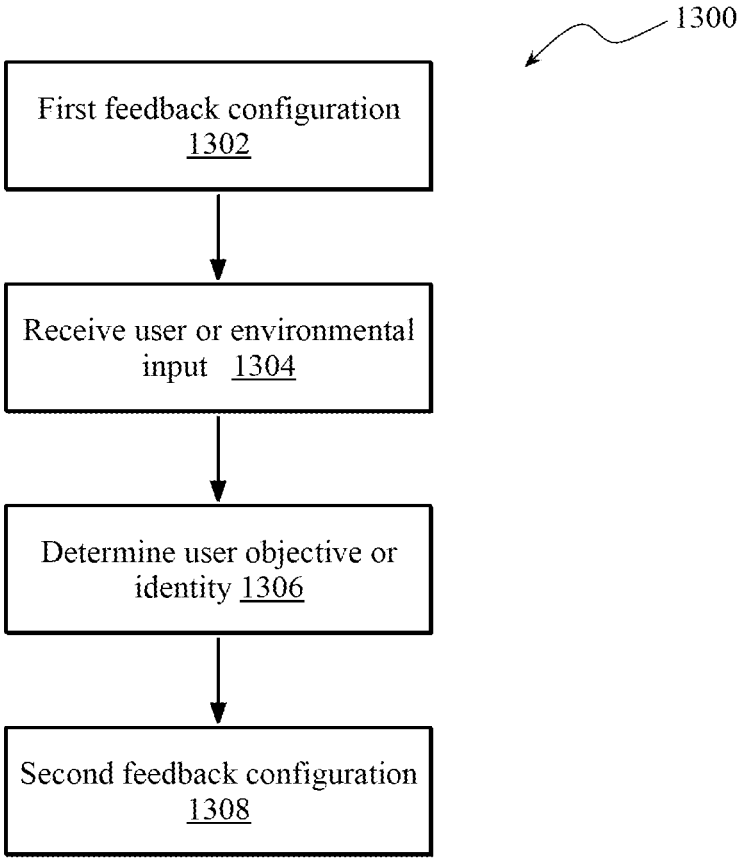
FIG. 13 is a diagram illustrating a process of the present disclosure.

In some embodiments, the speed or input force values can be associated with user identity or related preferences. FIG. 13 is a flow diagram illustrating a process 1300 for controlling feedback provided by actuators to keycaps in this manner. Actuators of a system of the present disclosure can have an initial or first feedback force configuration, as indicated in block 1302. This configuration can be a default feedback configuration, such as the force-displacement curve 1200 shown in FIG. 12, or it can be a user-determined or an otherwise existing first feedback configuration at the outset of the process 1300.

In block 1304, the system can receive user or environmental input. In some embodiments, user input and environmental input are both received. The user or environmental input can comprise, for example, a force applied to at least one keycap or a movement of at least one keycap. Encoders or other sensors that are part of the key mechanism can transduce the force or movement into an electrical signal communicated to a controller. Another type of user input can be launching a program or application on a computer connected to the input device. Environmental input can comprise user characteristics, user preferences, environmental conditions (e.g., ambient noise, vibration, illumination, temperature, humidity, and similar factors).

In some embodiments, the signal can be used by the controller to determine a user objective, as indicated in block 1306. A user objective can comprise an activity or goal that the system can enhance or support by modification of the actuator feedback or positioning of the keycaps. A user objective can include activities or goals such as interacting with a specific type of program or inputting a specific type of information. For example, the user objective can comprise interacting with a game where keys perform unique game control functions, and the actuators can be modified to provide feedback (e.g., in a second feedback configuration; see block 1308) corresponding to the game control functions or to provide feedback that gives non-visual indication of a function of a key being pressed. Thus, if the W, A, S, and D cluster of keys (or another game-indicating group of keys) is operated with relatively high frequency or with higher than usual force or velocity as received in block 1304, the signals from the keys can be used by the controller to determine that the user objective is a game being played. Afterward, changes to the feedback configuration (in block 1308) can be made in response to the determined objective.

In another example, the user objective can comprise interacting with a code writing program, typing input program, or word processor program, and the actuators can be modified to provide improved typing feedback or to provide feedback that gives non-visual indication of words, code strings, or symbols being provided. For example, the input can comprise a high frequency of occurrence of parenthesis, brackets, other code-specific characters, strings (e.g., "WHILE", "INT", or "IF . . . THEN"), and the controller can determine that the user objective is to write code.

In yet another example, the user objective can comprise inputting a specific type of information, and the actuators can be modified to provide typing feedback to indicate to the user that that type of information is or is not being provided. The controller can determine that the word is being typed by tracking keys recently pressed, recognizing a pattern in those keys, and anticipating the next keys that will be pressed. For example, the controller can determine that a word is being typed, and the actuators can be controlled to retract keys that are not part of that word or to cause keys to protrude that are part of that word. In related example, the word being typed can be a password or other predetermined set of input, and the actuators can be controlled to change the positioning or travel of keys (e.g., retracting or raising the key surfaces or changing the bottom-out displacement of the keys) or change feedback (e.g., modifying weight, modifying tactility, or changing the sound of the feedback) after the password is typed correctly or incorrectly.

The user or environmental input of block 1304 can also be used by the controller to determine a user identity, as indicated in block 1306. The user identity can comprise a personal identity or registered identity of the user providing the input or can comprise categorizing the user as a member of a group or type of user. The keys pressed, the force applied to a key, the direction of the input, the velocity of the input, and combinations thereof can be interpreted by the controller as correlating with a user identity or a type of user, and the controller can then adjust the feedback provided by actuators in a manner corresponding to the detected user identity or type of user, as indicated in block 1308.

To illustrate, the system can store user information about a user that indicates his preference for a heavier key feel, for fast typing, or for a predilection to make certain types of typing mistakes. The system can have a first feedback force configuration prior to the user providing input to the keys. When the user starts typing on the keyboard, the controller can detect, via the nature of the typing, identifying characteristics of the user based on the speed, force, and input provided.

Accordingly, the user's identity can be determined in block 1306. In response, a second feedback configuration can be implemented in block 1308 that corresponds to the user's identity, such as by changing the weight of the keys to the user's preferred weight, changing the tactility or force-displacement function followed by the actuators, changing the overall travel distance of the keys (thereby making typing require less key movement to bottom-out), adjusting the weight or changing the vertical position of certain keys in the keyboard (thereby making the user less likely to trigger an infrequently-used key by mistake), making similar reconfigurations, and combinations thereof.

Referring again to FIG. 13, in some embodiments, the process 1300 can comprise having a first feedback configuration as shown in block 1302 and receiving user or environmental input as shown in block 1304. Determining a user identity can be omitted in some cases, and a second feedback configuration can be implemented (as in block 1308). For instance, the user or environmental input received in connection with block 1304 can be indicative of an instruction to the controller to implement the second feedback configuration in connection with block 1308. As an example, a user can provide a sequence of key inputs in connection with block 1304 that then causes the second feedback configuration to be implemented in connection with block 1308. Alternatively, a force applied to the keycaps, a speed of typing, a speed of key movement, or other input characteristic received in connection with block 1304 can cause the second feedback configuration to be implemented in connection with block 1308. Accordingly, the user input itself can be a trigger that causes changes in the feedback configuration of the controller and actuators without determining a user objective or identity. Using the input to directly change feedback settings can be beneficial in many practical applications such as, for example, when a light typist uses the keyboard, the feedback can be reduced in force or resistance in order to make typing less straining on the hands and fingers.

Accordingly, the process 1300 can be a process for reducing user strain in response to detecting typing characteristics. Similarly, if a user types with heavy force, the feedback can provide an audible buzzer, extra tactile bump, or tactile vibration in a force-displacement curve to the finger to alert or guide the user away from damaging the key mechanism or from causing a stress injury to a finger. The change in feedback (e.g., the buzzer or vibration) can also indicate a status of a device or software component, such as by providing the change in feedback when a password is entered incorrectly on the keyboard or when keyboard backlighting is turned on or off. The process 1300 can therefore be a process for alerting a user to a device or software status or a process for guiding a user's input in response to detecting typing characteristics.

In some embodiments, the feedback configurations can include actuator output settings that affect the sound made when a key mechanism is operated. For example, actuators can be configured to provide various sounds such as clicks or buzzing noises in response to key presses or at certain points along the travel of certain key mechanisms in the device. In some embodiments, these acoustic elements of the systems can be adjusted without changing the force feedback profile. In some cases, the force feedback profile can cause sounds to be made. For example, a force-displacement curve can have a quieter bottom-out sound if the bottom-out stiffness is low and cushioned as compared to a curve with a high bottom-out stiffness that results in a harsher click or clack at full key travel.

Thus, a user with a preference for a quieter or louder keyboard can adjust the keyboard settings to provide less or more noise while typing. Additionally, a device maker can configure a keyboard to make more or less noise as an additional type of operational feedback that can affect the end user's perception of quality and key feel. For example, a keyboard can have a first feedback configuration including a louder sound output during certain activities (e.g., while typing a document in a word processor, during daytime operating hours, at other times when sound can improve the user's interaction with the device, when a noise-enjoying user is operating the device, or in similar circumstances) and can have a second feedback configuration including less or softer sound output during other activities (e.g., while playing a game, during operation of the keyboard in a nighttime setting, or in other instances where operation of the keyboard could be an auditory nuisance or otherwise less desirable to the user of the device or others nearby). In this manner, the systems described herein can be used to control auditory feedback in addition to, or as an alternative to, force feedback.

Figure 14:
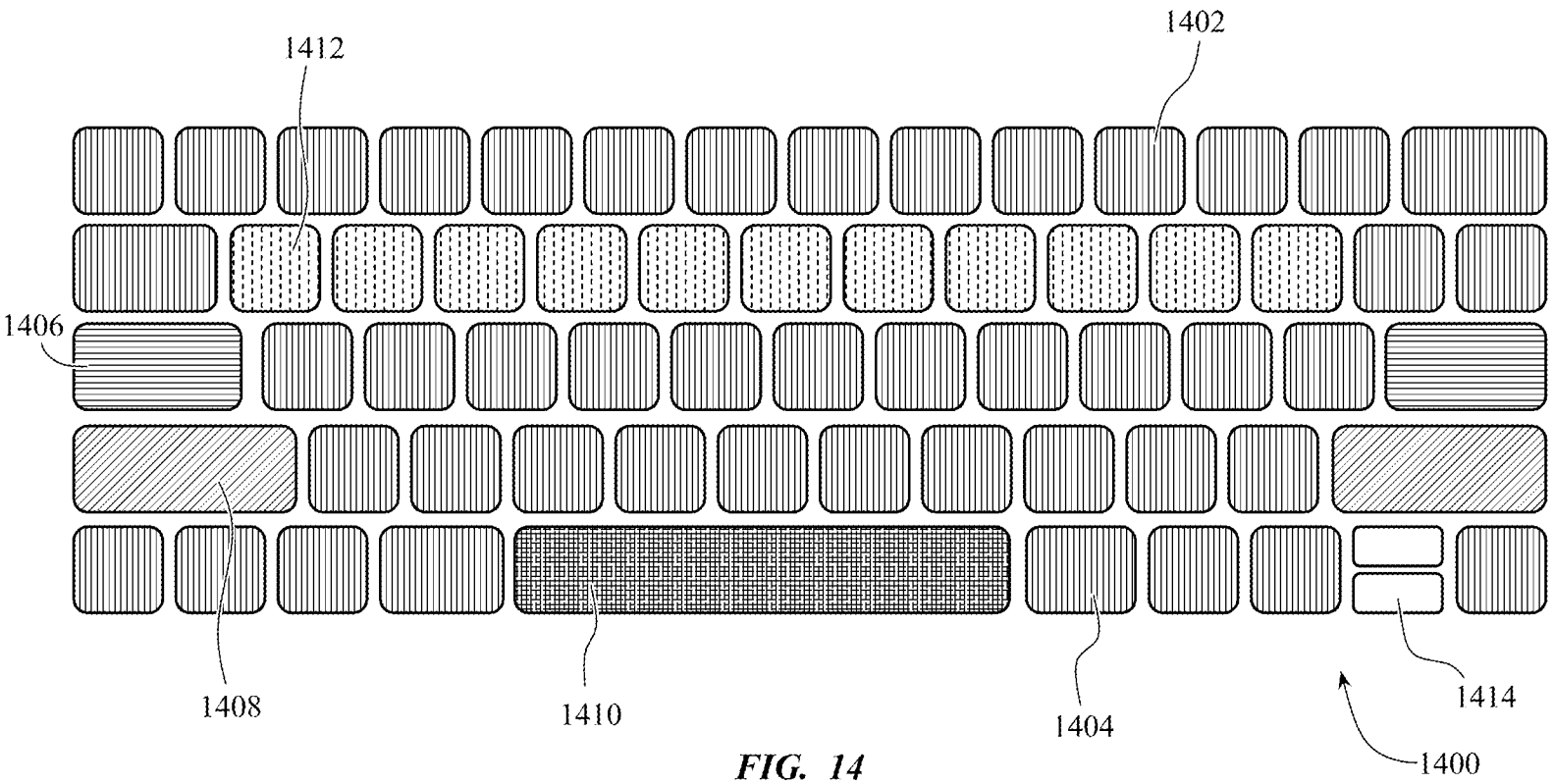
FIG. 14 is a diagram illustrating a keyboard layout with assigned actuator settings according to an embodiment of the present disclosure.

FIG. 14 shows a keymap 1400 in which a set of keyboard keys (e.g., 1402) are positioned. Actuators for each of the keys can be individually configurable or configurable in groups to provide varying types of feedback for the individual keys. As shown in FIG. 14, the keymap 1400 can include first sets of keys 1402, 1404 that have a first feedback profile and various other sets of keys (e.g., sets of keys including keys 1406, 1408, 1410, 1412, 1414) that have second, third, fourth, fifth, or sixth (or more) feedback profiles. Such profiles can be arranged, for example, based on the type of key (e.g., In some embodiments, the user can customize the groupings of keys or the feedback provided by individual keys in order to implement their own preferred feedback layout. For example, a user may desire stronger feedback for keys that are conventionally actuated by their pointer or middle fingers, while desiring a weaker feedback for keys conventionally actuated by their pinky fingers. Accordingly, different groups of keys within a keyboard can have feedback settings appropriate to their function or the user's task. In some embodiments, the different groups of keys can be arranged with different feedback settings in order to test multiple types of feedback at once. In one example, keycaps that are likely to be pressed by smaller or weaker fingers can have their force feedback reduced in magnitude in order to make it easier to press those keys with the weaker fingers. In addition, some of the keys can lack or can be configured to operate without actuators or encoders.

Some individual keys can have different settings in order to provide a homing function for the user. Similar to how the F and J keys on conventional keyboards have homing features (e.g., bumps, scoops, or deep dish curvature), particular keys in the keyboard can have a homing feature such as a special force or audible feedback indicator (e.g., a feedback bump, feedback "texture" feel, feedback sound, etc.) when they are touched or operated.

A keyboard can have a set of keys in the keymap 1400 that include compressible domes or other biasing supports designed to have a predetermined amount of force feedback. As a result of manufacturing tolerances or over the course of time (e.g., due to usage and wear), the supports can have different force feedback values. Actuators in the keys can be operated to augment the feedback of these supports in order to help standardize or correct the feedback provided by the supports. Thus, the actuators can be used to equalize the feel of key mechanisms within the same keyboard that have different physical characteristics (e.g., some of the domes are worn out or have different inherent feedback characteristics after their manufacture).

Figure 15:
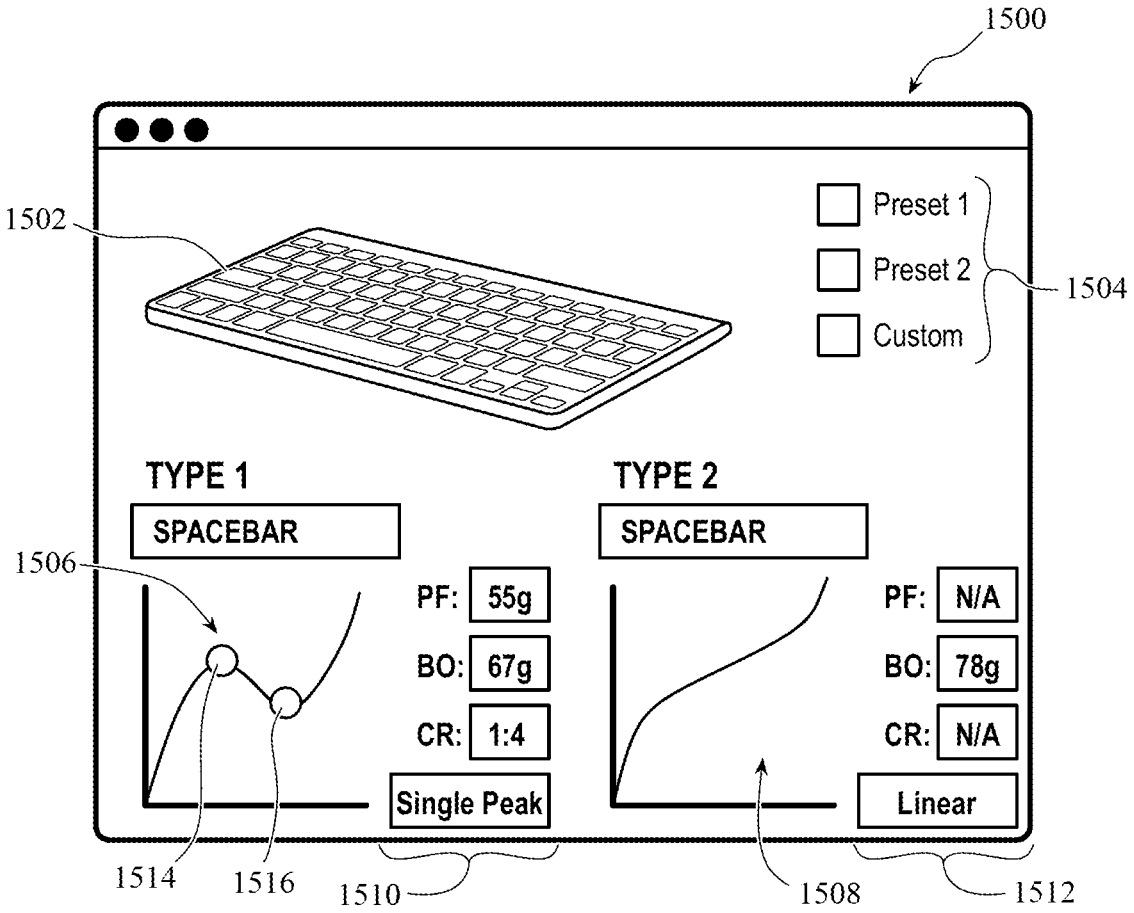
FIG. 15 illustrates a graphical user interface of the present disclosure.

FIG. 15 shows a graphical user interface element 1500 that can be part of systems described herein or that can be used to interact with systems described herein. For example, the user interface element 1500 can be displayed to a user by a computer in order to receive or display parameters related to the systems and their feedback. In the schematic representation shown in FIG. 15, the user interface element 1500 is an on-screen window, yet it will be apparent to those having skill in the art that various other types of user interfaces (e.g., indicator lights, an audible/voice interface, etc.) can comprise some or all of the information and interactive elements of the user interface element 1500.

In this representation, the user interface element 1500 comprises a visual representation of keys in a keyboard 1502, stored feedback settings 1504, multiple force-displacement profile indicators 1506, 1508 and multiple force-displacement profile settings 1510, 1512. The representation of the keyboard 1502 can indicate which key or keys are being adjusted using the user interface element 1500. It can also indicate a layout of the input device being adjusted, settings of the keys within the keyboard (e.g., a color code or visual pattern indicating the force and audio feedback settings of various keys in the keyboard similar to keymap 1400), and related information.

The feedback settings 1504 information can indicate various presets and custom profiles for the user to select. For instance, a user can select a first profile or setting value (e.g., "Preset 1") corresponding to a first force-displacement function for a given key or keyboard that can assign or modify settings for the key or keyboard to match the first profile or setting value selected. A user can therefore choose a first profile for a tactile force feedback and a second profile (e.g., "Preset 2") for a linear or smoother force feedback.

The profile indicators 1506, 1508 can comprise graphical representations of the force-displacement profiles or curves for a selected key or keyboard. A first profile indicator 1506 can correspond to settings for a first key or group of keys, and a second profile indicator 1508 can correspond to settings for a different key or group of keys. Similarly, a first profile indicator 1506 can correspond to settings for a key or group of keys when a first type of input is provided (e.g., when the "SPACEBAR" is pressed relatively softly or slowly), and the second profile indicator 1508 can correspond to settings for the same key or group of keys when a second type of input is provided (e.g., when the "SPACEBAR" is pressed harder or faster), as explained in greater detail above in connection with FIG. 12.

In some embodiments, the profile indicators 1506, 1508 can comprise graphical interface handles 1514, 1516 or similar interactive elements allowing the user to, via a pointing device such as a mouse cursor or touch interface, change characteristics of the profiles such as the peak force, bottom-out force, and other curve characteristics described elsewhere herein. In some embodiments, a user can trace out or draw a curve on the profile indicators 1506, 1508 for the output to follow. Similarly, the profile settings 1510, 1512 can provide the user with an input area in which specified numerical values or other settings can be implemented. For example, a user can select a preset curve such as a "SINGLE PEAK" curve with a shape similar to the one shown in profile indicator 1506 or a "LINEAR" feedback curve with a shape similar to the one shown in profile indicator 1508. The user can select a feedback force value for other curve features by inputting a weight value (e.g., weight in grams) for peak force, bottom-out force, click ratio, or other characteristics (not shown).

In some embodiments, the signals provided to actuators in the keyboard can be updated in real-time, wherein manipulation of the settings of the user interface element 1500 can change the actuator feedback of the system for substantially instantaneous testing and other exploration of different settings. This can allow the user to rapidly and easily find and implement preferred settings without having to exchange or physically adjust hardware components. Furthermore, as used herein, "receiving user input" in connection with other embodiments disclosed herein (e.g., block 1304) can comprise using the user interface element 1500 to receive desired force or audio feedback settings, keyboard layouts, or other information provided by a user.

Figure 16:
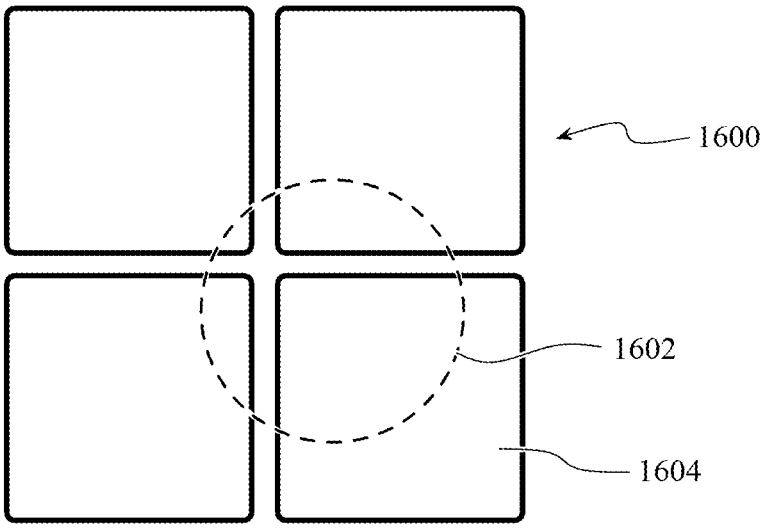
FIG. 16 illustrates adjacent keys according to an embodiment of the present disclosure.

At times the various systems disclosed herein can be used to modify operation of individual keys within a set of keys. FIG. 16 is a diagram of a set of keys 1600 positioned adjacent to each other in a keyboard. Users providing input to the keys 1600 can apply force to the keys with a fingertip that can at times overlap or strike multiple keys simultaneously, such as by a fingertip applying force covering the limits of circle 1602. Each of the keys 1600 engaged by the finger can move or receive force in different amounts.

A controller connected to the encoders or other sensors for each of the keys 1600 can detect that a particular key (e.g., key 1604) is the intended target key of the user input and that the other keys are not the intended target. For example, the controller can measure via force sensors that a greater force applied to a particular key and a lesser force applied to the others. The controller can then determine that the key receiving the greater force was the intended target. Similarly, the controller can detect via encoders that one of the keys is moved further than the others, and the controller can detect that the most-moved key is the intended target. The controller can also determine which of the keys 1600 is the intended target key based on past user input, such as by predicting that one key 1604 is the most likely target key because it is the next letter in a word being typed by the user or because based on past history the user is more likely to mistakenly hit neighboring keys or more likely to hit a backspace or delete key after one of the other keys is struck. Accordingly, the controller can reactively or predictively sense which key is the intended target key when input overlapping circle 1602 is provided.

In response, the system can modify feedback settings for the keys 1600. In one case, the system can at least temporarily change (e.g., stiffen) the force feedback of the keys 1600 except for the intended target key 1604 in order to make it harder for inadvertent force applied to those keys to register as a key press. In another case, the system can provide force or audible feedback to the user when the non-target keys are pressed so as to alert the user to her determined typing mistake. In another case, the system can operate actuators for the non-target keys to change their vertical displacement (e.g., to retract them) to provide different key feel or key definition, and to reduce the chance that a user will press on the non-target keys or increase the change that the user will press on the target key 1604.

In some embodiments, the actuators can be used to adjust the position of keys in other ways. For example, the actuators can be used to lower or raise key height in response to movement of other parts of a device. In a notebook computer, keys can be lowered by the actuators when a lid or display of the notebook is moved into a closed or keyboard-facing configuration. In some embodiments, the actuators can output high frequency movement to cancel or dampen rattle or vibration sounds coming from the key mechanisms, device fans, speakers, or other parts of the system in which they are positioned. High frequency movement by the actuators can also change the perceived texture of the key movement or to output a sound. In environments with high sensed vibrations, key height can be increased to reduce inadvertent key pressing or other unwanted activation. Key heights can be reduced in an idle state (e.g., when a laptop lid/display is closed over the keys) to avoid contact between keys and other objects (e.g., the lid/display or another cover).

FIG. 17 shows a high-level block diagram of a computer system 1700 usable in various embodiments of the present disclosure. In various embodiments, the computer system 1700 can comprise various sets and subsets of the components shown in FIG. 17. Thus, FIG. 17 shows a variety of components that can be included in various combinations and subsets based on the operations and functions performed by the system 1700 in different embodiments. It is noted that, when described or recited herein, the use of the articles such as "a" or "an" is not considered to be limiting to only one, but instead is intended to mean one or more unless otherwise specifically noted herein.

The computer system 1700 can comprise a central processing unit (CPU) or processor 1702 connected via a bus 1704 for electrical communication to a memory device 1706, an electronic storage device 1710, a network interface 1712, an input device adapter 1716, and an output device adapter 1720. For example, one or more of these components can be connected to each other via a substrate (e.g., a printed circuit board (PCB) or other substrate 210 as described above) supporting the bus 1704 and other electrical connectors providing electrical communication between the components. The bus 1704 can comprise a wired or wireless communication mechanism for communicating information between parts of the system 1700. The system 1700 can include motion control, data acquisition, power amplifying, and cooling devices as well as a switching module that allows a single control module (i.e., processor 1702) to be connected to several key mechanisms/modules and that enables instantaneous switching between various hardware configurations.

The processor 1702 can be configured to receive and execute a set of instructions 1724 stored by the memory device 1706. The memory device 1706 can be referred to as main memory, such as random access memory (RAM) or another dynamic electronic storage device for storing information and instructions to be executed by the processor 1702. The memory device 1706 can also be used for storing temporary variables or other intermediate information during execution of instructions executed by the processor 1702. The storage device 1710 can comprise read-only memory (ROM) or another type of static storage device coupled to the bus 1704 for storing static or long-term (i.e., non-dynamic) information and instructions for the processor 1702. For example, the storage device 1710 can comprise a magnetic or optical disk, solid state memory (e.g., a solid state disk), or a comparable device. A power source (not shown) can comprise a power supply capable of providing power to the processor 1702 and other components connected to the bus 1704, such as a connection to a utility electrical grid or a battery system.

The instructions 1724 can comprise information for executing processes and methods using components of the system 1700. Such processes and methods can include, for example, the processes described in connection with FIGS. 9-16 (e.g., 1300) and other methods and processes described herein that can be executed using the processor 1702.

The network interface 1712 can comprise an adapter for connecting the system 1700 to an external device via a wired or wireless connection. For example, the network interface 1712 can provide a connection to a computer network such as a cellular network, the Internet, a local area network (LAN), a separate device capable of wireless communication with the network interface 1712, other external devices or network locations, and combinations thereof. In one example embodiment, the network interface 1712 is a wireless networking adapter configured to connect via WI-FI®, BLUETOOTH®, or a related wireless communications protocol to another device having interface capability using the same protocol. In one embodiment, a network device or set of network devices can be considered part of the system 1700. In some cases, a network device can be considered connected to, but not a part of, the system 1700.

The input device adapter 1716 can be configured to provide the system 1700 with connectivity to various input devices such as, for example, keyboards, pointer devices (e.g., mice or trackballs), capacitive sensor arrays (e.g., in touchscreen interfaces), microphones, scanners or biometric sensors, light sensors, force sensors, thermal transducers, cameras, game controllers, eye trackers, related devices, and combinations thereof. In an example embodiment, the input device adapter 1716 is connected to switches 1717, sensors/encoders 1718, and actuators 1719 such as those found in keyboard switches and in key mechanisms described elsewhere herein (e.g., 200). The switches 1717 and sensors/encoders 1718 can be configured to provide an electrical signal to the processor 1702 via the bus 1704 when they are triggered or otherwise operated in response to application of a force to a keycap.

The output device adapter 1720 can be configured to provide the system 1700 with the ability to output information for a user, such as by providing output using one or more output devices 1722 (e.g., displays, speakers, or projectors) that provide visual or audible output. Other output devices can also be used such as, for example, a piezoelectric or other haptic element in a keyboard. The processor 1702 can be configured to control the output device adapter 1720 to provide information to a user via the output devices 1722 such as the visual user interface element 1500.

Other examples and implementations are within the scope and spirit of the disclosure and appended claims. For example, features implementing functions can also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

To the extent applicable to the present technology, gathering and use of data available from various sources can be used to improve the delivery to users of invitational content or any other content that may be of interest to them. The present disclosure contemplates that in some instances, this gathered data can include personal information data that uniquely identifies or can be used to contact or locate a specific person. Such personal information data can include demographic data, location-based data, telephone numbers, email addresses, TWITTER® ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For example, the personal information data can be used to deliver targeted content that is of greater interest to the user. Accordingly, use of such personal information data enables users to calculated control of the delivered content. Further, other uses for personal information data that benefit the user are also contemplated by the present disclosure. For instance, health and fitness data can be used to provide insights into a user's general wellness, or can be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user can be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification can be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed.

It will be apparent to one of ordinary skill in the art that many modifications and variations are possible in view of the above teachings.

What is claimed is:

1. A computer interface system, comprising:
a processor;
a keyboard in electronic communication with the processor, the keyboard comprising:
a first key mechanism comprising a first keycap, a first rotary encoder, and a first actuator coupled to the first rotary encoder via a first actuator arm; and
a second key mechanism comprising a second keycap, a second rotary encoder, and a second actuator coupled to the second rotary encoder via a second actuator arm, wherein the first rotary encoder and the second rotary encoder are independently rotatable in response to respective translation of the first actuator arm and the second actuator arm; and
a memory device in electronic communication with the processor, the memory device storing instructions, wherein, upon receipt of the instructions from the memory device, the processor is configured to:
detect a signal from the first key mechanism;
determine a user objective from the signal;
adjust a first feedback force according to a first force-displacement curve applied by the first actuator arm to the first key mechanism based on the user objective; and
adjust a second feedback force according to a second force-displacement curve applied by the second actuator arm to the second key mechanism based on the user objective, the second-force displacement curve differing from the first force-displacement curve.

2. The computer interface system of claim 1, wherein determining the user objective comprises determining an anticipated input, wherein at least one of the first feedback force and the second feedback force are adjusted to guide a user to the anticipated input.

3. The computer interface system of claim 2, wherein the anticipated input comprises a word or phrase.

4. The computer interface system of claim 1, wherein the first feedback force and the second feedback force comprise different force values.

5. The computer interface system of claim 1, wherein determining the user objective comprises detecting an unintentional user input, wherein at least one of the first feedback force and the second feedback force are adjusted to reduce repetition of the unintentional user input.

6. The computer interface system of claim 1, wherein the first key mechanism and the second key mechanism respectively comprise a first biasing member and a second biasing member.

7. The computer interface system of claim 6, wherein:
the first biasing member is configured to apply a portion of the first feedback force; and
the second biasing member is configured to apply a portion of the second feedback force.

8. A computer interface system, comprising:
a processor;
a keyboard in electronic communication with the processor, the keyboard comprising:
a first key mechanism comprising a first keycap, a first rotary encoder, and a first actuator coupled to the first rotary encoder via a first actuator arm; and
a second key mechanism comprising a second keycap, a second rotary encoder, and a second actuator coupled to the second rotary encoder via a second actuator arm, wherein:
the first rotary encoder and the second rotary encoder are independently rotatable in response to respective translation of the first actuator arm and the second actuator arm;
the first actuator is configured to apply a first feedback force via the first actuator arm based on a user objective; and
the second actuator is configured to apply a second feedback force via the second actuator arm based on the user objective, the second feedback force differing from the first feedback force.

9. The computer interface system of claim 8, wherein:
the first feedback force corresponds to a first force-displacement curve; and
the second feedback force corresponds to a second force-displacement curve differing from the first force-displacement curve.

10. A computer interface system, comprising:
a processor;
a keyboard in electronic communication with the processor, the keyboard including:
an actuator; and
a keycap linked to the actuator; and
a memory device in electronic communication with the processor, the memory device storing instructions, wherein, upon receipt of the instructions from the memory device, the processor is configured to:
receive a user input at the keycap;
transmit an electrical signal via an encoder configured to transduce keycap movement from the user input;
determine, via the processor, a category of a user based on the electrical signal, wherein the category of the user comprises a group membership or a type of user; and
provide a feedback signal to the actuator in response to the user input to the keycap, the feedback signal causing the actuator to apply a feedback force to the keycap corresponding to the category of the user.

11. The computer interface system of claim 10, wherein the user input comprises at least one of a force applied to the keycap during the user input, a direction of the user input, or a velocity of the user input.

12. The computer interface system of claim 10, wherein the feedback force includes a first feedback force for a first category of users and a second feedback force for a second category of users.

13. The computer interface system of claim 12, wherein the first feedback force differs from the second feedback force.

14. The computer interface system of claim 10, wherein the user input is provided to multiple keycaps.

15. The computer interface system of claim 10, wherein the encoder comprises a position sensor, and wherein the user input is a displacement of the keycap sensed by the position sensor.

16. A computer interface system, comprising:
a processor;
a keyboard in electronic communication with the processor, the keyboard including:
an actuator; and
a keycap linked to the actuator; and a memory device in electronic communication with the processor, the memory device storing instructions, wherein, upon receipt of the instructions from the memory device, the processor is configured to:

receive a user input;

transmit an electrical signal via an encoder configured to transduce keycap movement from the user input;

determine, via the processor, a category of a user based on the electrical signal, wherein the category of the user comprises a group membership or a type of user; and provide a feedback signal to the actuator in response to receiving the user input, the feedback signal causing the actuator to vary a feedback force to the keycap, the feedback force corresponding to the category of the user.

17. The computer interface system of claim 16, wherein:

the keycap is a first keycap and the keyboard includes a set of keycaps;

the actuator is a first actuator of a set of actuators, each keycap of the set of keycaps linked to a respective actuator of the set of actuators; and the processor determines the category of the user based on user input received at two or more keycaps of the set of keycaps.

18. The computer interface system of claim 16, wherein the processor determines the category of the user based on an amount of force applied to the keycap.

19. The computer interface system of claim 16, wherein the processor determines the category of the user based on a direction of force applied to the keycap.

20. The computer interface system of claim 16, wherein the processor determines the category of the user based on a velocity of force provided to the keycap.

* * * * *